US009723897B2

(12) United States Patent
Polite

(10) Patent No.: US 9,723,897 B2
(45) Date of Patent: Aug. 8, 2017

(54) SHARPS PROTECTOR

(71) Applicant: Rosemary M. Polite, Divide, CO (US)

(72) Inventor: Rosemary M. Polite, Divide, CO (US)

( * ) Notice: Subject to any disclaimer, the term of this patent is extended or adjusted under 35 U.S.C. 154(b) by 0 days.

(21) Appl. No.: 14/918,365

(22) Filed: Oct. 20, 2015

(65) Prior Publication Data

US 2016/0113343 A1 Apr. 28, 2016

Related U.S. Application Data

(60) Provisional application No. 62/067,385, filed on Oct. 22, 2014.

(51) Int. Cl.

| | |
|---|---|
| ***A44B 9/10*** | (2006.01) |
| ***A41H 17/00*** | (2006.01) |
| *A44B 9/04* | (2006.01) |

(52) U.S. Cl.

CPC ..... *A44B 9/10* (2013.01); *A41H 17/00* (2013.01); *A44B 9/04* (2013.01)

(58) Field of Classification Search

CPC ..... A41H 17/00; D05B 97/04; D05B 91/00; D05B 91/04; D05B 91/08; B65D 85/24; B65D 85/27–85/29; A44B 9/10; A44B 9/04; A61B 17/04

USPC ..... D3/22, 28

See application file for complete search history.

(56) References Cited

U.S. PATENT DOCUMENTS

| | | | | | |
|---|---|---|---|---|---|
| 1,020,890 | A * | 3/1912 | Doucet | A44B 9/10 | 24/706.9 |
| 1,024,563 | A * | 4/1912 | Eckhart | A44B 9/10 | 24/706.9 |
| 1,034,331 | A * | 7/1912 | Allabough | A44B 9/10 | 24/706.9 |
| 1,084,553 | A * | 1/1914 | Magee | A44B 9/10 | 24/706.9 |
| 1,088,871 | A * | 3/1914 | Blessing | A44B 9/10 | 24/706.9 |
| 1,258,345 | A * | 3/1918 | Kilson | A44B 9/10 | 24/706.9 |
| 2,040,289 | A * | 5/1936 | Adams | D04B 3/00 | 223/109 R |
| 5,490,858 | A * | 2/1996 | Shuter | A61B 17/0493 | 606/139 |
| 6,439,382 | B1 * | 8/2002 | Wolfe | D04B 3/00 | 206/380 |
| 8,052,017 | B2 | 11/2011 | Ivison | | |
| 8,844,777 | B2 | 9/2014 | Ivison | | |

* cited by examiner

*Primary Examiner* — Ismael Izaguirre
(74) *Attorney, Agent, or Firm* — Kyle W. Rost

(57) ABSTRACT

A sharps protector is formed of a hard, pierce-resistant shell filled with a receptor material. One or two ends of the shell provide entry, and a center or end wall is a pierce-resistant barrier limiting pin push-through. The receptor material is set back at each entry end, thereby establishing a pre-entry pocket that prealigns the pin for accurate entry. Exterior surfaces of the protector are coded to indicate entry positions and barrier positions, using visual or tactile coding. Glow-in-the-dark or reflective material on the surface of the shell aids recovery of dropped protectors.

5 Claims, 3 Drawing Sheets

SHARPS PROTECTOR

BACKGROUND OF THE INVENTION

Field of the Invention

The invention generally relates to apparel apparatus such as spool and implement holders. More specifically, the invention relates to holders for needle or pin.

Description of Related Art

In sewing and tailoring, a garment might be fitted at preliminary and intermediate times when the assembly is not complete. Straight pins are the most common means for holding the garment in a proposed fit. Of course, pins are prone to stick anyone who encounters their sharp end, which might be anyone involved with handling or wearing the garment. There has been no reasonable solution to this problem.

A few known devices might help but are not practical. For example, safety pins can be closed to guard the point, but these are slow and clumsy to use. Interestingly, various sharps such as injection needles in medical practice are supplied with a covering shell to protect them before use, but medical personnel typically dispose of the used sharp in a special sharps disposal container, without reinserting the needle in the original shell. In this case, it appears there is an avoided danger of self-injury to the medical person if he tried to reapply the cover.

Recent U.S. Pat. No. 8,052,017 for a Pin Moor proposes using a chunk of rubber, plastic, foam, paper, neoprene, or the like with a pin to help hold together layers of a quilt during construction. The proposed soft materials offer no protection to self-injury and otherwise seem clumsy in use, like a safety pin.

It would be desirable to create a protector for sharps such as straight pins, but applicable to other types of sharps, that protects from inadvertent sticks. Similarly, it would be desirable to provide a sharps protector that offers efficient and prompt handling with features such as dual end reception, and communicates this ability to the user using one or more senses.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a sharps protector that receives the sharp end of straight pins, protects the user from insertion errors, and requires minimal cognizant attention for use.

According to the invention, a sharps protector is formed of a body portion having a side periphery configured as a longitudinally elongated shell and with first and second opposite ends disposed transversely to the direction of elongation. At least said first end of the body portion is open to receive, in use, an inserted pin. A fill material occupies the shell behind the first end for receiving and retaining, in use, a pin inserted through the first end. At least at the first end, the shell is configured with a transverse flange partially closing the first end and retaining the fill material against extraction, in use, by withdrawal of an inserted pin from the first end.

According to another aspect of the invention, a sharps protector is formed of a body portion that defines a side periphery that is configured as a longitudinally elongated shell and with first and second opposite ends disposed transversely to the direction of elongation, wherein at least the first end of the body portion is open to receive, in use, an inserted pin. A fill material occupies the shell behind the first end for receiving and retaining, in use, a pin inserted through the first end. A barrier wall is at least partially contained within the shell at a preselected longitudinal position and is oriented transversely to the direction of elongation.

A band on the side periphery of the body portion is located at a position corresponding to the preselected longitudinal position of the barrier wall. In use, the band position informs the user of the available depth in the body portion for receiving an inserted pin.

The fill material is set back from the first end. The set-back establishes a pre-entry pocket at the first end for receiving, in use, a pin to be inserted in the first end. The pocket aids in pre-aligning the pin for accurate entry into the fill material behind the pocket in the sharps protector.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is directed to improvements in a sharps protector, which can be embodied as a protector for the sharp end of a straight pin, primarily for use in activities such as sewing and tailoring. The sharps protector is formed of a hard, pierce-resistant shell filled with a receptor material. One or two ends of the shell provide entry for a pin. A barrier wall limits pin entry to prevent a pin from being pushed through the sharps protector. The position of the barrier wall depends upon whether one or both ends of the sharps protector are open for receiving a pin. Where a single end is open, the barrier wall is located at the opposite end of the sharps protector. Where both ends are open, the barrier wall is located at the center of the sharps protector. The receptor material is set back at each entry end, thereby establishing a pre-entry pocket. The pocket pre-aligns the pin for accurate entry into the receptor material. Exterior surfaces of the protector are coded to indicate entry positions and barrier positions, using visual or tactile coding.

Figure 1:
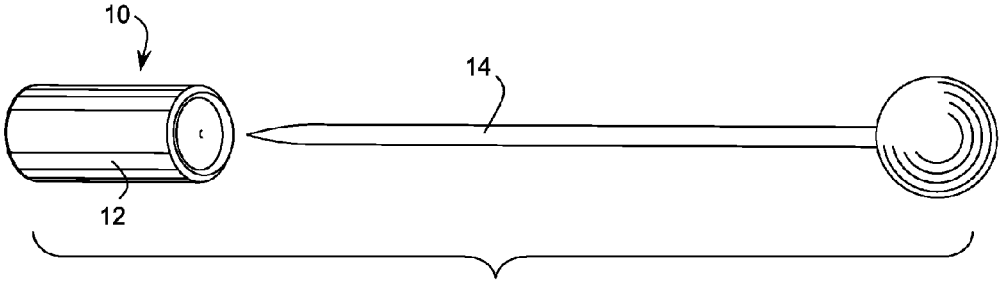
FIG. 1 is an isometric view of a sharps protector positioned to receive the sharp end of a straight pin, where the sharps protector is of a first design.

With reference to the drawings, FIG. 1 shows a first embodiment of several alternate embodiments of the sharps protector. According to FIG. 1, the sharps protector 10 is formed of a body portion that has a generally elongated side periphery defined by a shell wall 12. The length of the shell is substantially greater than the transverse dimension. The shell defines opposite ends, at least one of which is open and suited to receive an inserted pin end. The second end is either open or closed, as will described, subsequently. The preferred shell is formed as a regular geometric figure such as a cylinder and will be described as a cylinder for purposes of example and not limitation. As other examples, instead of being a cylinder, the shell may have an oval or elliptical transverse configuration, or the shall may be formed of a plurality of flat wall segments. It is desired that the shape of the shell be tactilely identifiable to enable a user to orient the shell to receive a pin without requiring visual confirmation of the orientation. For this reason, a cylinder is a preferred shape.

From the perspective that the shell is a cylinder or a closely derived shape from a cylinder, it is sized with a slightly larger diameter than a typical straight pin 14. The shell may provide an inner diameter that is five to ten times the typical diameter of a straight pin. The body portion is formed of a material that strongly resists accidental penetration by a pin, such as metal or hard plastic. Either type material can be cast, extruded or molded to form a cylindrical shell. Because it is desirable to protect against pin push-through, a transverse wall can close the cylinder at a selected location, such as at an end opposite the open entry end, or between opposite open entry ends. Such a penetration resistant wall is located in the expected path of pin insertion. The barrier wall can be a unitary part of the shell, such as a part formed in the molding or casting of the shell, or the barrier wall can be subsequently formed by a reprocessing of the shell. The barrier wall also can be a separate structure such as a disk or plug that is attached to the shell at a preselected depth or location, depending upon the desired configuration of the finished body portion.

The shell body 12 can be defined as having a front or forward end at the right in the view of FIG. 1, and having a rear end at the left in the view of FIG. 1. According to this orientation, the front and rear ends are at opposite longitudinal ends of a central axis that follows the conventional height of a cylinder. The diameter of the body 12 is measured transversely to the height. Cylinder 12 may have a typical diameter of about one-quarter inch (6 mm), creating a sufficient opening at the forward end thereof to receive the pointed end of pin 14 with a comfortable side margin to ensure that the pin easily enters the cylinder rather than bypassing the opening.

Figure 2:
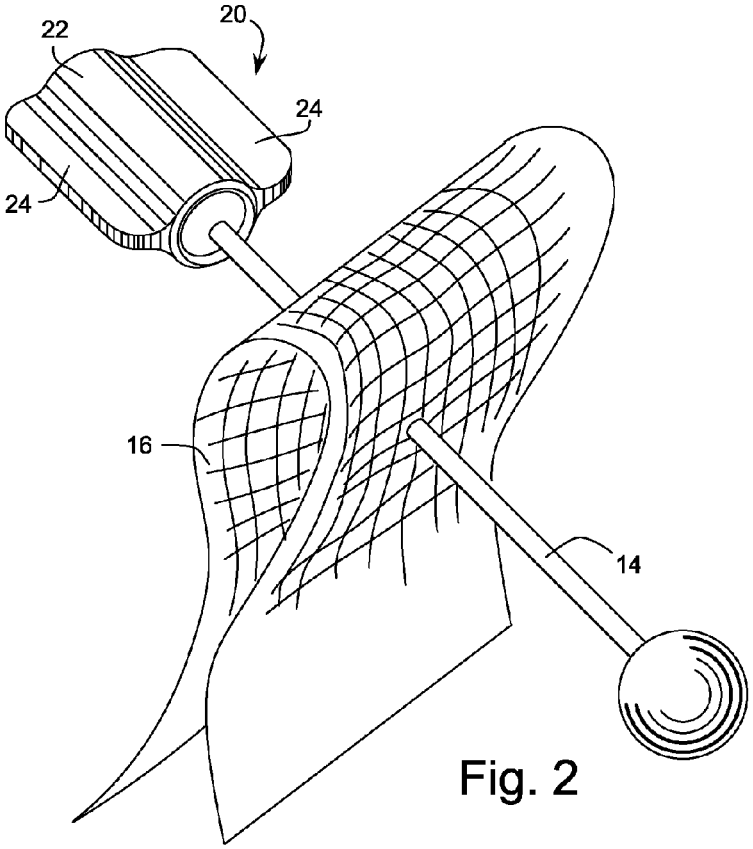
FIG. 2 is an isometric view of a sharps protector received on the sharp end of a straight pin, showing a multilayer fabric held on the pin, wherein the sharps protector is of a second design.
Figure 3:
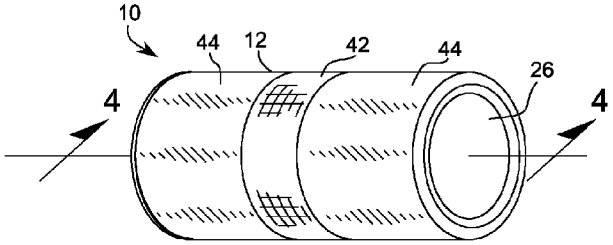
FIG. 3 is an isometric view of a sharps protector of the general design shown in FIG. 1, with markings indicating surface characteristics at a central band and at each end thereof.

In FIG. 2, the sharps protector 20 is formed of a modified body that aids in tactically establishing orientation of the sharps protector. In this second embodiment, the side periphery is defined by a similar cylinder-like shell or housing body portion 22 that is modified by the addition of one or more longitudinally oriented, laterally extending wings or ribs 24. Each wing or rib may extend from the side of the shell body 22 by a distance similar to the diameter of the shell body. In use, a user typically applies the sharps protector 10, 20 to a pin by feel, while pinning fabric sheet goods 16 attendant to a sewing or tailoring process. The shell 12, 22, with or without added wings 24, provides a directional orientation for hand application of the protector to a pin without requiring visual guidance. Therefore, the shape of the sharps protectors 10, 20 is suitable for tactile recognition and orientation by the user's fingers. In many instances, the user will hold a large plurality of the sharps protectors in the user's hand and sequentially will feed them seriatim toward the user's fingers for application to pins. The orientation process can begin as each sharps protector 10, 20 is worked from the hand toward the fingers. The height or longitudinal dimension of the shell 12, 22 in either embodiment of the sharps protector is greater than the diameter to aid in achieving proper orientation at the fingers. A suitable height is on the order of two to four times the diameter of the shell. When embodiment 20 is used with the added wings 24, the wings further aid in achieving a proper orientation during feeding from hand to fingers.

FIGS. 3-7 show further features of the invention. One such feature is that the shell 12, 22 is open at one end or, optionally, at both ends, creating at least one entry end 26 for receiving a pin. The shell 12 is filled behind each open entry end 26 with a suitable material 28 for receiving and retaining the pin point. Suitable fillers include, but are not limited to, silicone, natural or synthetic foam, and rubber. Key elements in choosing a filler are ease of pin insertion, coupled with reasonable retention. The filler 28 can be recessed behind the open end 26 for a preselected depth or distance, thereby creating a pre-entry reception pocket 27. The pocket 27 serves as a pre-insertion station that pre-aligns the pin to be inserted, thereby ensuring that during an attempted insertion, the pin will not tend to slip off the entry end of the sharps protector. Where only one end of the shell is open, at the limit of the depth the shell contains a barrier wall that is impenetrable by the pin point under ordinary circumstances of use, to prevent pin push-through.

Figure 4:
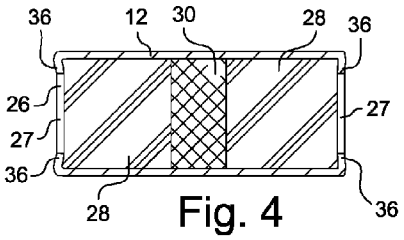
FIG. 4 is a vertical cross-section of the sharps protector of FIG. 3, taken along a plane through line 4-4 of FIG. 3.

The embodiments of FIGS. 3-7 show the optional structure in which opposite ends of the sharps protector are open, and a barrier wall is positioned near the middle of the longitudinal length of the shell. Specifically, FIG. 4 shows a shell 12 formed from a thin walled metal tube in which the barrier wall 30 is a plug pushed into the tube from either end and forced to a central position. Subsequently, the ends of the tube are formed or reformed into a radial or inward folded flange or lip 36, which conditions the end edges to be non-sharp and ergonomic to the fingers or fabric and also retains the filler 28 against extraction when a needle is withdrawn.

Figure 5:
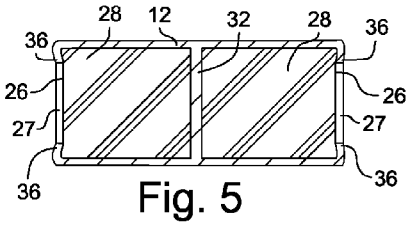
FIG. 5 is a view similar to FIG. 4, showing another embodiment thereof.

In the embodiment of FIG. 5, the shell 12 itself is unitary with a central barrier wall 32, which is a molded or cast portion of the shell. As in FIG. 4, the barrier wall 32 of FIG. 5 is near the longitudinal center of the shell 12, and a filler 28 is present on both faces of the center barrier wall so that both ends of the shell can be used to receive and retain a pin point. Flanges 36 form strengthening, ergonomic edges around both front and rear end openings 26. Both front and rear end openings may form entry pockets or pre-insertion stations 27.

Figure 6:
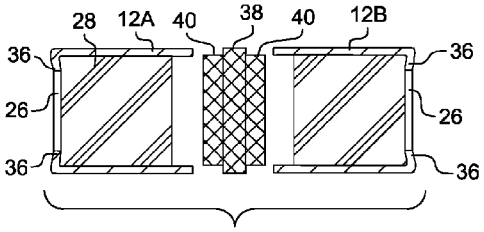
FIG. 6 is a view similar to FIG. 4, showing another embodiment thereof.

The embodiment of FIG. 6 shows a shell that includes a division between a forward portion and a rearward portion. The divided sub-portions 12A and 12B may be approximately equal in size so that each defines about one half of the assembled housing, from one end to the center. A barrier wall 38 is a separate component from the shell wall and is sized to fit between the opposite halves of the shell, with the periphery of barrier wall 38 exposed at the surface of the shell. Front and rear faces of barrier wall 38 carry opposite plug-like protrusions 40 that are sized and shaped to enter and engage the open middles of the shell sub-portions 12A and 12B and to support the sub-portions in an assembled arrangement. The barrier wall can be differentiated from the shell wall by a difference in color. It is suitable for barrier wall 38 and plugs 40 to be molded from black plastic material to add a visual indication of the location of the barrier wall within the shell wall, and the exposed peripheral surface of the barrier wall may be rough textured to to aid in tactile identification and to improve handling. The assembly may be strengthened by adhesive means, physical interlock, friction increasing means such as crimping, or any combination thereof. The filler 28 is employed between barrier wall 38 and each end opening 26, as previously described, and in-turned flanges 36 dress the edges of the openings and strengthen the periphery of the opening.

Figure 7:
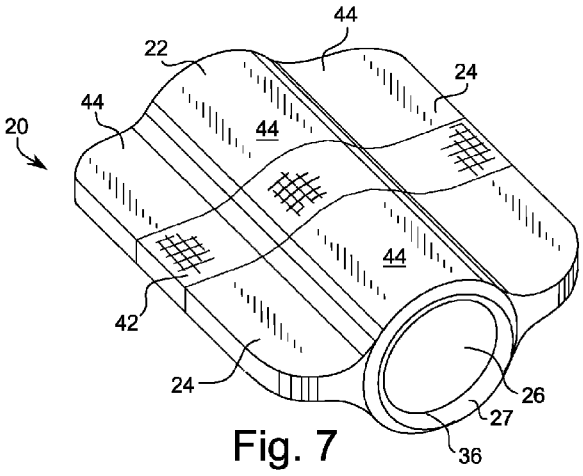
FIG. 7 is an isometric view of a sharps protector of the general design shown in FIG. 2, with markings indicating surface characteristics similar to those shown in FIG. 3.

FIG. 7 illustrates that a winged shell 20 is adaptable to use the same types of center wall structures as described for use with a shell 12, mutatis mutandis. On the surface of the winged shell 20, a band 42 defines the approximate location of a barrier wall, which can be similar to any of the barrier walls described for use with sharps protector 10 in FIGS. 3-6. For example, band 42 in FIG. 3 or 7 can be formed of the exposed peripheral edge of a central molded wall 38 as disclosed in FIG. 6, or it can be an applied coating, surface treatment, or object that is suited to signify the presence and location of a middle wall, such that the user is informed that the protector has two ends suited to receive pin points. Each sharps protector 10, 20 can be further identified by a coating, surface treatment, or object 44 on each end portion having an opening 26 to inform the user that a receptor opening is present. Where color is employed, black is a suitable color for the central band 42; and green is a suitable color for the end portions 44. The central band 42 and opposite end portions 44 also may be differentiated and identified by the use of different tactile finishes, so that the user can know from handling the various sharps protectors whether an opening 26 will be found on one end or both.

Figure 8:
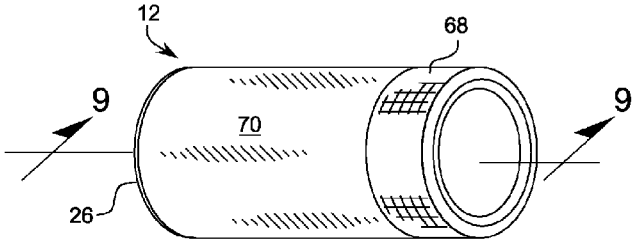
FIG. 8 is an isometric view of a sharps protector of the general design shown in FIG. 1, with markings indicating surface characteristics at a rear band and over the remainder forward thereof.
Figure 9:
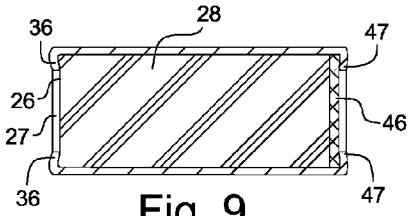
FIG. 9 is a vertical cross-section of the sharps protector of FIG. 8, taken along a plane through line 9-9 of FIG. 8.

FIGS. 8-13 show embodiments of the invention in which shell 12 is open at only one end 26 for receiving a pin. The shell 12 is filled behind the one open entry end 26 with the suitable filler material 28 for receiving and retaining the pin point. The filler material 28 can be set back behind the open end 26 by a preselected depth or distance that establishes a receiving pocket 27 for pre-aligning the point of a pin before it is pushed into the filler material. This set back distance may be approximately the wall thickness of shell 12, 22 at the mouth of the open end, which also can be estimated by the wall thickness of flange 36. A barrier wall is located at the opposite end of the shell from open end 26. Specifically, FIG. 9 shows a shell 12 formed from thin-walled metal tube that at least initially is open at both ends before assembly is complete. A barrier wall 46 acts similarly to a plug that is pushed into the tube 12 from either end and forced to a selected end position, shown at the right according to the arrangement of FIG. 9. The plug 46 can be pushed into the intended open end 26 before end 26 is flanged. The opposite end of the shell can be pre-flanged with flange 47 before inserting wall 46 to allow the wall 46 to be pushed against the pre-formed flanges at edge 47 and seated. Thus, barrier wall 46 seals against the flange 47 on the right end, according to the view of FIG. 9. Suitable plugs can be formed of a metal or plastic disc. Once the plug 46 is in place, flange 36 can be formed at the open end of the tube. At the sealed end where the plug 46 is located, the flange 47 assists in retaining the barrier wall 46 against outward displacement during use.

Figure 10:
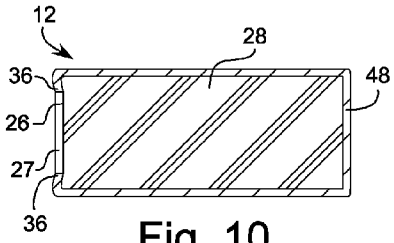
FIG. 10 is a view similar to FIG. 9, showing another embodiment thereof.

In the embodiment of FIG. 10, the shell 12 forms the barrier wall 48 as a molded or cast end portion that is unitary with the remainder of the shell. As in FIG. 9, the barrier wall 48 of FIG. 10 is near a longitudinal end of the shell 12. As previously described, a filler material 28 is present between the barrier wall 48 and the opposite open end 26 so that the open end 26 of the shell can be used to receive and retain a pin. A flange 36 at open end 26 forms a strengthening, ergonomic edge around the single end opening 26 of FIG. 10.

Figure 11:
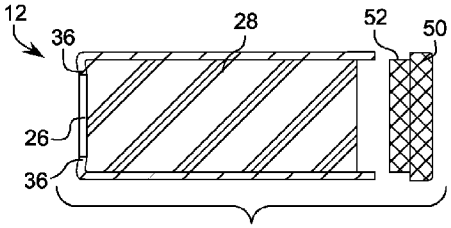
FIG. 11 is a view similar to FIG. 9, showing another embodiment thereof.

In the embodiment of FIG. 11, an external end wall closes the second end of shell 12 and defines a barrier wall 50. While this embodiment somewhat resembles FIG. 9, the barrier wall 50 differs by its position as an external disc, where barrier wall 46 of FIG. 9 is an internal disc. Barrier wall 50 carries a plug-like protrusion 52 on its forward facing surface. The plug 52 is sized to enter the second end of the shell 12 to support external disc 50 outside the end of the shell. As previously discussed in connection with FIG. 6, adhesive means, physical interlock, friction increasing means such as crimping, or any combination thereof can secure the end plug 52 to the shell. As also previously described, a filler material 28 is employed between the end plug 52 and the front end opening 26, and in-turned flanges 36 dress the edges of the opening 26.

Figure 12:
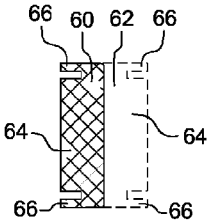
FIG. 12 is a vertical cross-sectional view of a barrier wall configured as a cap.

FIG. 12 shows an alternative barrier wall 60, which can substitute for an end wall 50 in the embodiment of FIG. 11. Similarly, by the addition of a mirror image face 62 shown in dashed lines, the barrier wall 60 can serve as a double-faced structure, which is an alternative to a center wall 38 in the embodiment of FIG. 6. While barrier wall 60 optionally may employ forward and rearward interior plug-like protrusions 64, such plug-like protrusions can be supplemented or replaced by an exterior ring 66 that fits around the juxtaposed edge(s) of the shell, somewhat like the skirt of a jar lid. Such an externally exposed ring 66 serves as a tactile element that notifies the user of where the barrier wall is located within the assembled housing.

Figure 13:
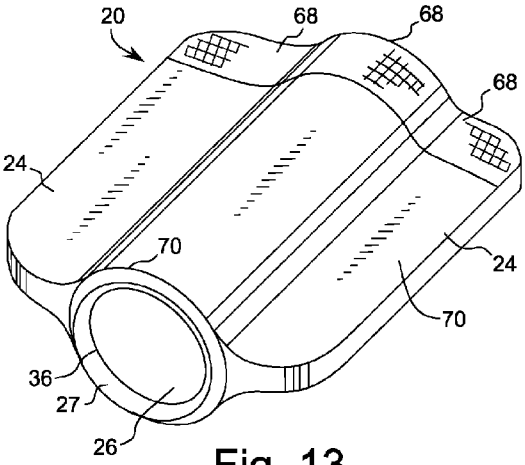
FIG. 13 is an isometric view of a sharps protector of the general design shown in FIG. 2, with markings indicating surface characteristics similar to those shown in FIG. 8.

FIG. 13 illustrates that a shell 20 is adaptable to use the same types of end wall structures as described for use with shell 12. An end band, which also might be called a rear end band 68 on the surface of the shell 12, 20 defines the approximate location of the barrier wall in either embodiment of the protector 10, 20 as shown in FIGS. 8 and 13. Optionally, end band 68 of FIG. 13 extends for the full width of shell 20, including over the ends of wings 24 to provide an expanded area of visual and tactile notice to the user, such that the user is informed that the protector has an opposite end 70, which might be called the front end, suited to receive pin points. When either of the exterior walls or caps 50, 60 are adapted to the ribbed structure of FIG. 13, optionally the caps may be molded to form continuations of the wings 24. Another option is for the end caps to be cylindrical or otherwise conformed to the transverse shape of the shell 12, and to attach to shell 20 as a cylindrical tail that does not supplement the wings 24.

An external band is not necessary in every embodiment. With or without the presence of a band, a barrier wall will function to limit entry distance of a pin and thereby will inform the user of the limit on insertion depth. However, even in those embodiments where a band is not specifically illustrated, such as in FIGS. 1, 2, 5, 9, and 10, the presence of a band 42 is optional and such a band can be applied to identify the presence and position of any barrier wall.

The rear shell portion 68 and front shell portion 70 may be colored or textured according to a coordinated system that cooperatively informs the user which end is which. Each shell 12, 20 can be further identified by a coating, treatment, or object 70 on the front portion to inform the user of the location where the receptor opening 26 is found. As previously suggested, where color is employed, black is a suitable color for the rear end band 68; and green is a suitable color for the front end portion 70. Expanding upon what has been previously disclosed, the various barrier wall structures in FIGS. 9-12 may be of different widths. Where the barrier wall is externally exposed as in the example of walls 50, 60, 64 the external surface of the barrier wall may serve as its own color coding band or texture band 68 and may define its own preselected width. Alternatively, the rear end band 68 may be an applied coating, treatment or textured object. It is within the scope of the invention for the front end portion 70 to be an applied texture or textured object as well or in the alternative.

Selected coatings, treatments, or objects may be applied to one or both rear and front areas 68, 70, or central and end areas 42, 44, as part of an identification scheme as described, above, or optionally to improve handling. Such treatments may include knurling or formation of any other irregular surface.

A further desirable coating is a glow-in-the-dark finish covering some or all of the sharps protector. This type of finish is helpful for finding the sharps protectors that might be dropped during use. At the end of day, for example, the user might switch off the room light to retrieve the dropped pieces, which would have residual glow. This type of finish can be created by mixing a phosphorescent powder with a carrier that is applied to the sharps protector. A solvent or oil-based medium can be mixed with uncollated glow powder and applied by spray. A water-based medium can be mixed with coated glow powder, also known as coated phosphorescent pigment, and applied to the sharps protector. Phosphorescent powders are available in different particle sizes. Larger particles produce a rougher surface that adds a higher friction finish to the sharps protector.

Another desirable coating is a reflective finish, which reacts with an applied light beam to reflect back the beam. Reflective finishes often are formed of clear spherical elements. By daylight, the reflection is not evident, but the light of a directed beam such as a flashlight at night makes the dropped sharps protectors easy to see on the room floor.

Glowing or reflective properties on the sharps protector can be incorporated in a variety of ways. As suggested, an applied finish is effective. Since the sharps protector is handled a great deal, it is desirable for the glowing or reflective property to be established in a way that resists wear such a rub-off. This desirable result can be achieved by incorporating the properties into a plastic or other molded component of the sharps protector, such as a molded band 42, or barrier walls 38, 50 and 60. Another protective structure is a recess such as a dimple or groove in the surface of the sharps protector. The entry end 26 may constitute a recess where the filler 28 is set back into the shell 12. The applied glow or reflective material can be contained in the pocket created by the set back. In versions 20 with lateral wings or ribs, the junction of a rib 24 to a cylindrical shell body 22 constitutes a protective groove.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A sharps protector, comprising:

a body portion defining a side periphery configured as a longitudinally elongated shell having first and second opposite ends disposed transversely to said direction of elongation, wherein at least said first end of the shell is open to receive, in use, an inserted pin;

fill material occupying said shell behind the first end thereof for receiving and retaining, in use, a pin inserted through the first end; and a barrier wall closing longitudinal passage through the shell and oriented transversely to the direction of elongation;

wherein, at least at the first end of the thereof, the shell is configured with a transverse flange partially closing the first end and retaining said fill material against extraction, in use, by withdrawal of an inserted pin from the first end;

wherein, a division separates the shell into a front portion including the first end thereof and a rear portion including said second end thereof;

wherein, said barrier wall is positioned between said front and rear portions of the shell, closing the division between them and displaying a periphery of the barrier wall between front and rear portions of the shell; and wherein, the barrier wall further comprises an external ring extending forward from a first face of the barrier wall, engaged around the front portion of the shell at said division, extending rearward from a second face of the barrier wall, and engaged around the rear portion of the shell at the division.

2. A sharps protector, comprising:

a body portion defining a side periphery configured as a longitudinally elongated shell having first and second opposite ends disposed transversely to said direction of elongation, wherein at least said first end of the shell is open to receive, in use, an inserted pin;

a barrier wall disposed centrally in the shell, relative to the direction of elongation, oriented transversely to the direction of elongation, and at least partially contained within the shell;

a fill material occupying the shell between the first end thereof and barrier wall and between said second end thereof and barrier wall, for receiving and retaining, in use, a pin inserted through the respective first end or second end of the shell;

wherein, the first and second ends of the shell are each configured with a transverse flange partially closing the respective first and second ends, retaining said fill material against extraction, in use, by withdrawal of an inserted pin from either of the respective ends.

3. A sharps protector, comprising:

a body portion defining a side periphery configured as a longitudinally elongated shell having first and second opposite ends disposed transversely to said direction of elongation, wherein at least said first end of the shell is open to receive, in use, an inserted pin;

fill material occupying said shell behind the first end thereof for receiving and retaining, in use, a pin inserted through the first end;

wherein, at least at the first end, the shell is configured with a transverse flange partially closing the first end and retaining said fill material against extraction, in use, by withdrawal of an inserted pin from the first end;

a barrier wall at least partially contained within the shell at a preselected longitudinal position, oriented transversely to the direction of elongation, and comprising a wall portion and a plug portion;

wherein, said wall portion is sized to fit against the shell in a transverse position and is positioned over said second end of the shell, closing the second end; and wherein, said plug portion is sized to fit inside the shell, support the wall portion in said transverse position and is engaged in the second end of the shell.

4. A sharps protector, comprising:

a body portion defining a side periphery configured as a longitudinally elongated shell having first and second opposite ends disposed transversely to said direction of elongation, wherein at least said first end of the shell is open to receive, in use, an inserted pin;

fill material occupying said shell behind the first end thereof for receiving and retaining, in use, a pin inserted through the first end;

wherein, at least at the first end thereof, the shell is configured with a transverse flange partially closing the first end and retaining said fill material against extraction, in use, by withdrawal of an inserted pin from the first end;

a barrier wall at least partially contained within the shell at a preselected longitudinal position and oriented transversely to the direction of elongation;

wherein, said barrier wall comprises a wall portion and a plug portion;

wherein, said wall portion is sized to fit against the shell in a transverse position;

wherein, said plug portion is sized to fit inside the shell and support the wall portion in said transverse position;

wherein, a division separates the shell into a front portion including the first end thereof and a rear portion including said second end thereof;

wherein, the wall portion of the barrier wall is positioned between the front and rear portions of the shell, closing the division between them and displaying a periphery of the wall portion between said front and rear portions of the shell;

wherein, the plug portion of the barrier wall comprises a first plug extending forward from a first face of the wall portion and engaged in the front portion of the shell at the division; and wherein, the plug portion of the barrier wall comprises a second plug extending rearward from a second face of the wall portion and engaged in the rear portion of the shell at the division.

5. A sharps protector, comprising:

a body portion defining a side periphery configured as a longitudinally elongated shell having first and second opposite ends disposed transversely to said direction of elongation, wherein at least said first end of the shell is open to receive, in use, an inserted pin;

fill material occupying said shell behind the first end thereof for receiving and retaining, in use, a pin inserted through the first end;

wherein, at least at the first end thereof, the shell is configured with a transverse flange partially closing the first end and retaining said fill material against extraction, in use, by withdrawal of an inserted pin from the first end;

a barrier wall at least partially contained within the shell at a preselected longitudinal position and oriented transversely to the direction of elongation;

wherein, said barrier wall is located inside the shell, juxtaposed to said second end; and wherein, a transverse flange at the second end of the shell partially closes the second end at the periphery of the barrier wall and retains the barrier wall against outward displacement from the shell.

* * * * *